US009636816B1

(12) United States Patent
Lopez

(10) Patent No.: US 9,636,816 B1
(45) Date of Patent: May 2, 2017

(54) REMOVABLE UNIVERSAL STAKE PULLER

(71) Applicant: James Lopez, Tome, NM (US)

(72) Inventor: James Lopez, Tome, NM (US)

( * ) Notice: Subject to any disclaimer, the term of this patent is extended or adjusted under 35 U.S.C. 154(b) by 366 days.

(21) Appl. No.: 14/520,630

(22) Filed: Oct. 22, 2014

Related U.S. Application Data

(63) Continuation-in-part of application No. 13/975,832, filed on Aug. 26, 2013, now Pat. No. 9,440,347.

(51) Int. Cl.
*B25F 1/00* (2006.01)
*E04G 19/00* (2006.01)

(52) U.S. Cl.
CPC ..... *B25F 1/00* (2013.01); *B25F 1/006* (2013.01); *E04G 19/00* (2013.01)

(58) Field of Classification Search
CPC ... B25F 1/006; B25F 1/00; B25D 1/04; E04G 19/00
See application file for complete search history.

(56) References Cited

U.S. PATENT DOCUMENTS 1,472,517 A * 10/1923 Fry ..... B25B 13/00 7/138
3,867,733 A * 2/1975 Verlander ..... B25C 11/00 254/132
D271,275 S 11/1983 Richilano
9,440,347 B1 * 9/2016 Lopez ..... B25F 1/006
2010/0043149 A1 2/2010 Chen

* cited by examiner

*Primary Examiner* — Robert Scruggs
(74) *Attorney, Agent, or Firm* — Stevenson IP, LLC

(57) ABSTRACT

A removable universal stake puller providing a working tool with a removable stake puller member for pulling a concrete foundation stake from the ground. A first and second plate with at least one pair of apertures to receive a fastener such as a set screw therethrough are provided and secure the present device to a working tool body. A stake puller member with a plurality of teeth is disposed on the second plate to pull concrete foundation stakes from the ground when attached to the working tool body and is removable allowing the present device to be used on a plurality of working tools such as a hammer, a crow bar, or a mallet.

7 Claims, 3 Drawing Sheets

REMOVABLE UNIVERSAL STAKE PULLER

BACKGROUND OF THE INVENTION

Various types of stake driver and removal tools are known in the prior art. However, what is needed is a removable universal stake puller providing a working tool, including a hammer, a crow bar, or a mallet, in combination with a first and second plate, each first and second plate having at least one pair of threaded apertures in direct alignment with each other that accept a fastener such as set screw to attach to the body of the working tool. A stake puller member having a plurality of teeth for pulling a concrete foundation stake from the ground is disposed on the second plate. Alternately the stake puller member with a plurality of teeth is disposed on the front wall of a second bracket and has at least one first bracket. The first and second brackets are secured around the working tool head by means of at least one pair of first holes and at least one pair of second holes that are in direct alignment with each other and accept a fastening device such as a set screw therethrough.

FIELD OF THE INVENTION

The present invention relates to stake driver and removal tools, and more particularly, to a removable universal stake puller that is removably attachable to a working tool body.

SUMMARY OF THE INVENTION

The general purpose of the present removable universal stake puller, described subsequently in greater detail, is to provide a removable universal stake puller which has many novel features that result in a removable universal stake puller which is not anticipated, rendered obvious, suggested, or even implied by prior art, either alone or in combination thereof.

To accomplish this, the present removable universal stake puller includes a first plate with a front side, a back side, a top side, a bottom side, a right side, a left side, and a V-shaped center portion of the back side. The v-shaped center portion securing engages a working tool and provides a more stable attachment than another shape such as a concave shape At least one pair of apertures is disposed through the front and back sides. One of each of the at least one pair of apertures is disposed proximal one of the right side and the left side. There is a second plate identical to the first plate. The second plate is disposed in a mirror image position relative the first plate. Each of the at least one pair of apertures of each of the first and second plates is disposed in direct alignment with each other and configured to securingly receive a fastener, such as a set screw, therethrough. The at least one pair of apertures is threaded. The securing engagement of the fasteners through each of the at least one pair of the apertures of both of the first and second plates secures the first and second plate together directly across from each other on a body of a working tool.

There is a first stake puller member, provided and sized to securingly engage and remove a concrete foundation stake from a ground surface, disposed on the left side of the second plate. The stake puller member has an upper portion disposed proximal the top side and a lower portion disposed proximal the bottom side. Each of the upper portion and the lower portion is perpendicular to the left side. Each upper portion and the lower portion has a convex external wall and an internal wall. There are a plurality of teeth disposed on the internal wall of each of the upper portion and the lower portion. The plurality of teeth provides a grip on a concrete foundation stake as it is removed from a ground surface.

The present device also has at least one first bracket with a front end, a back end, a top end, a bottom end a right end, a left end, and a first U-shaped channel continuously disposed between the right end and the left end. At least one pair of first holes is continuously disposed through the front and back ends, one of each of the at least one pair of first holes disposed on right end back end and the left end back end;

There is a second bracket having a front wall, a back wall, a top wall, a bottom wall, a right wall, a left wall, and a second U-shaped channel continuously disposed between the right wall and the left wall. There is at least one pair of second holes disposed on the back wall. One of each of the at least one pair of second holes is disposed on one of the right wall on the back wall and the left wall on the back wall. each of the at least one pair of first holes and each of the at least one pair of second holes is disposed in direct alignment with each other and each of the at least one pair of first holes and second holes is configured to securingly receive a fastening device therethrough. The securing engagement of the fastening device through each of the at least one pair of the first holes and second holes of both of the first and second brackets secures the first and second bracket together directly across from each other on a body of a working tool.

Each of the first channel and the second channel have a width greater than a width of the tool body to allow the first and second bracket to securingly engage the tool body.

A second stake puller member is centrally disposed the front wall of the second bracket. The second stake puller member has an upper section disposed proximal the top wall and a lower section disposed proximal the bottom wall. Each of the upper section and the lower section is perpendicular to the left wall and the right wall. Each upper section and lower section has a convex external side and an internal side. There is plurality of ridges disposed on the internal side of each of the upper section and the lower section.

Thus has been broadly outlined the more important features of the present removable universal stake puller so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
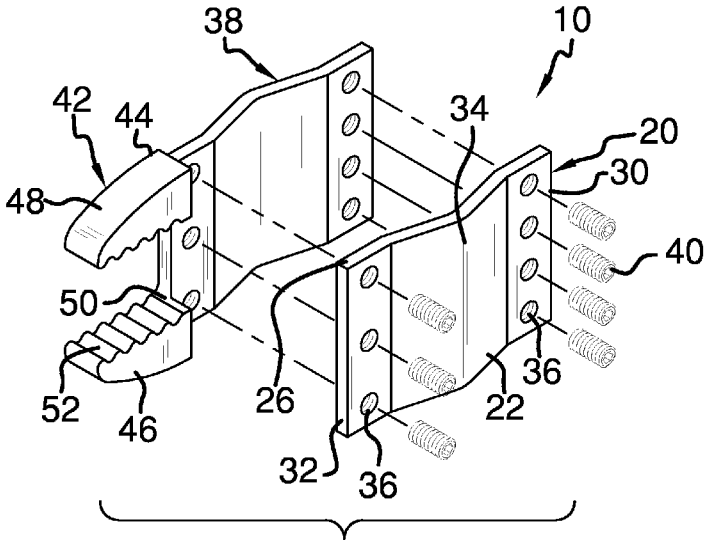
FIG. 1 is an isometric view showing
Figure 2:
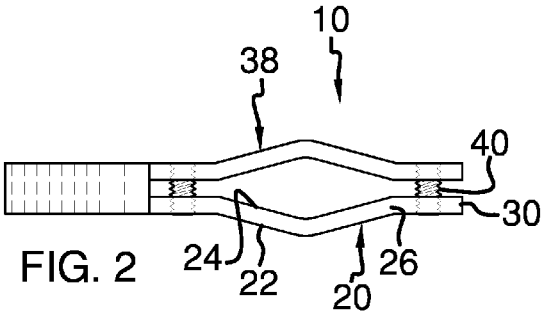
FIG. 2 is a top plan view.
Figure 3:
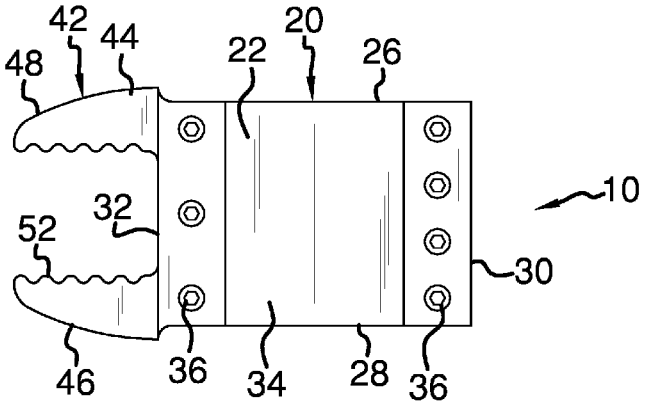
FIG. 3 is a front elevation view.
Figure 4:
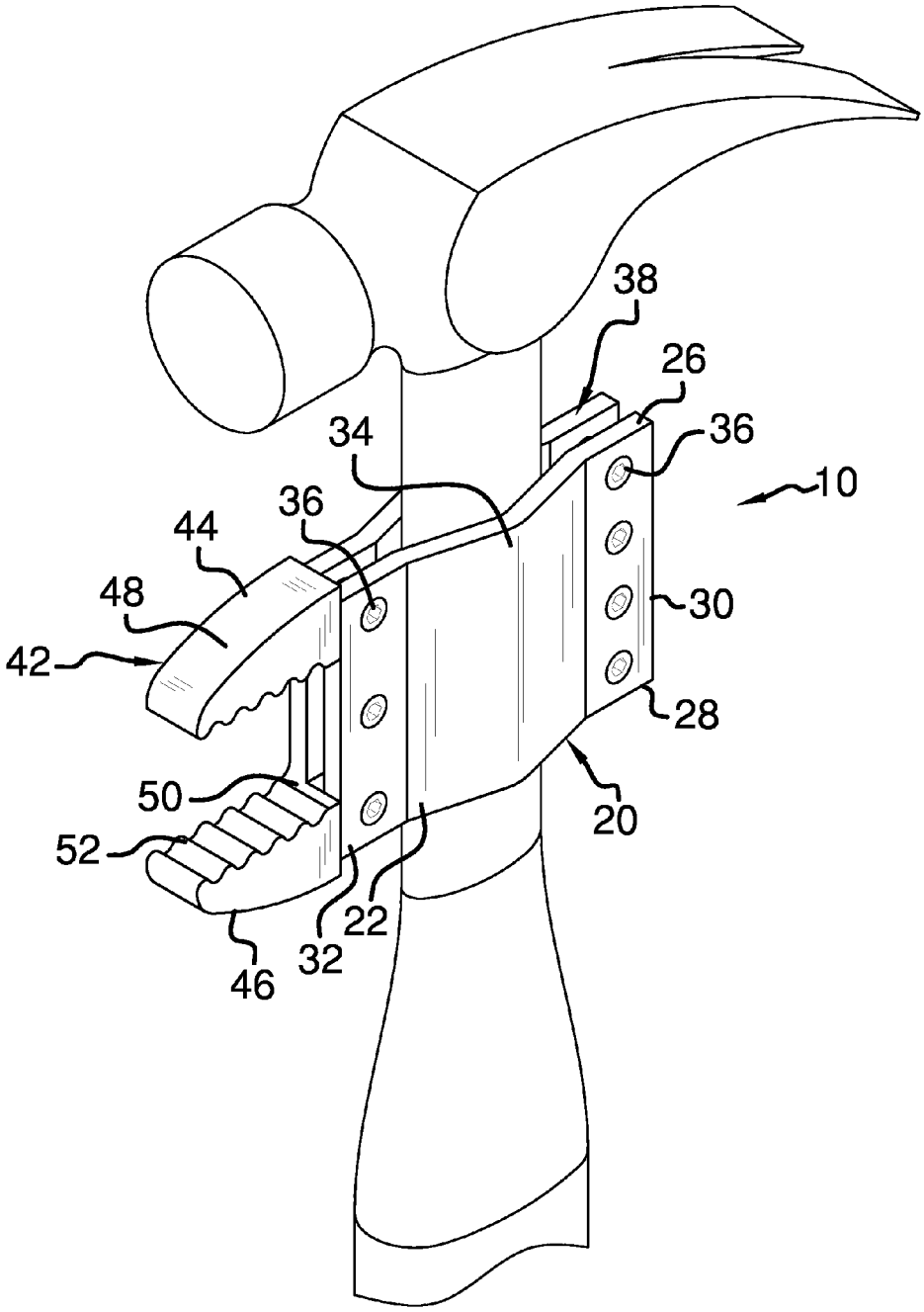
FIG. 4 is an in-use view showing the removable universal stake puller attached to a hammer.
Figure 5:
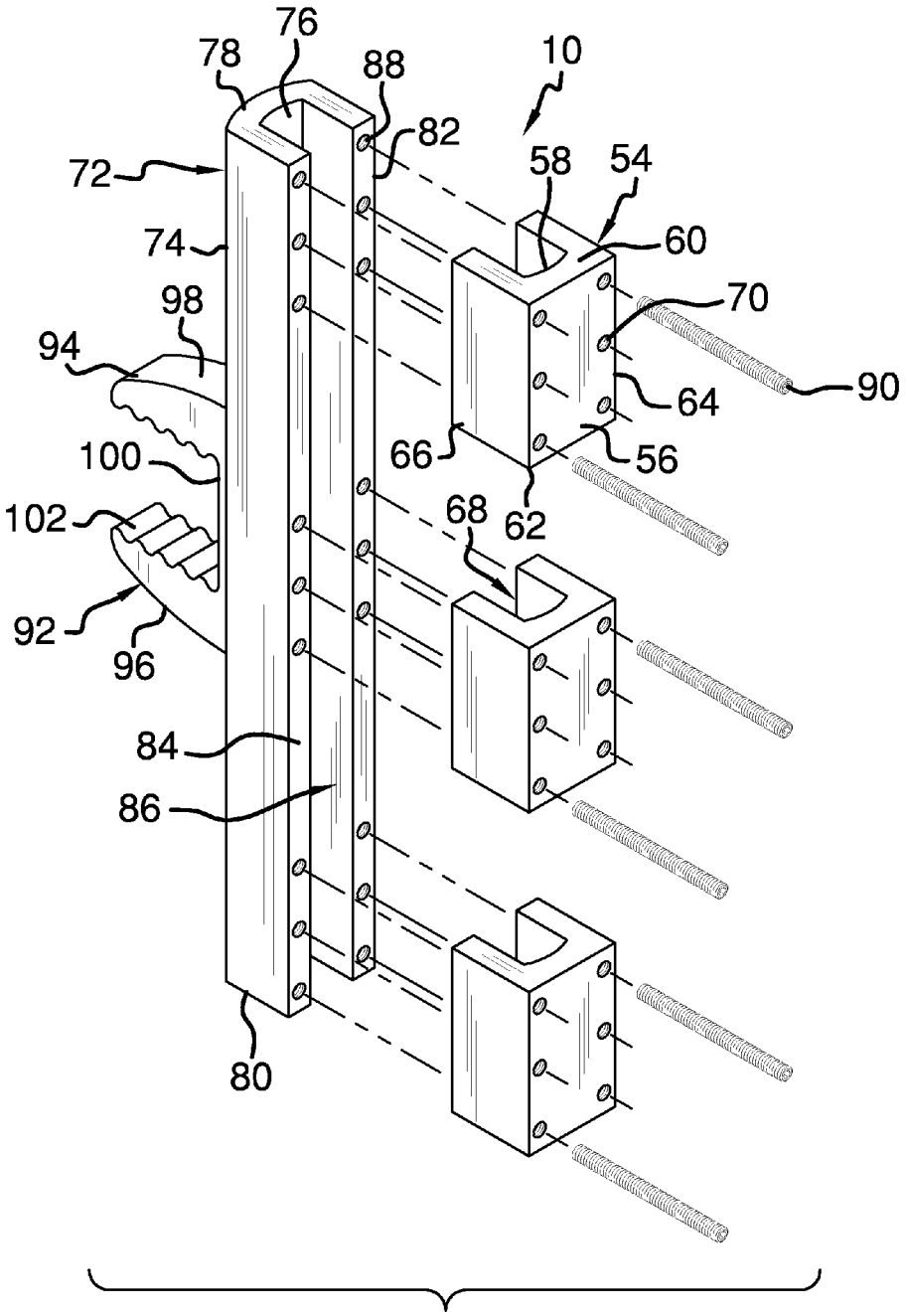
FIG. 5 is an isometric view showing the universal stake puller with at least one first bracket and a second bracket.

With reference now to the drawings, and in particular FIGS. 1 through 5 thereof, an example of the instant removable universal stake puller employing the principles and concepts of the present removable universal stake puller and generally designated by the reference number 10 will be described.

Referring to FIGS. 1 through 5 the present removable universal stake puller 10 is illustrated. The removable universal stake puller 10 includes a first plate 20 with a front side 22, a back side 24, a top side 26, a bottom side 28, a right side 30, a left side 32, and a V-shaped center portion 34 of the back side 24. The v-shaped center portion 34 securingly engages a working tool and provides a more stable attachment than another shape such as a concave. At least one pair of apertures 36 is disposed through the front side 22 and back side 24. One of each of the at least one pair of apertures 36 is disposed proximal one of the right side 30 and the left side 32. There is a second plate 38 identical to the first plate 20. The second plate 38 is disposed in a mirror image position relative the first plate 20. Each of the at least one pair of apertures 36 of each of the first and second plates 20, 38 is disposed in direct alignment with each other and configured to securingly receive a fastener 40, such as a set screw, therethrough. The at least one pair of apertures 36 is threaded. The securing engagement of the fastener 40 through each of the at least one pair of the apertures 36 of both of the first and second plates 20, 38 secures the first and second plate 20, 38 together directly across from each other on a body of a working tool.

There is a first stake puller member 42, provided and sized to securingly engage and remove a concrete foundation stake from a ground surface and is disposed on the left side 32 of the second plate 38. The first stake puller member 42 has an upper portion 44 disposed proximal the top side 26 and a lower portion 46 disposed proximal the bottom side 28. Each of the upper portion 44 and the lower portion 46 is perpendicular to the left side 32. Each upper portion 44 and the lower portion 46 has a convex external wall 48 and an internal wall 50. There are a plurality of teeth 52 disposed on the internal wall 50 of each of the upper portion 44 and the lower portion 46. The plurality of teeth 52 provides a secure grip on a concrete foundation stake as it is removed from a ground surface.

The present device 10 also has at least one first bracket 54 with a front end 56, a back end 58, a top end 60, a bottom end 62, a right end 64, a left end 66, and a U-shaped first channel 68 continuously disposed between the right end 64 and the left end 66. At least one pair of first holes 70 is continuously disposed through the front and back ends 56, 58. One of each of the at least one pair of first holes 70 disposed on the back end 58 proximal the right end 64 and one on the back end 58 proximal the left end 66.

There is a second bracket 72 having a front wall 74, a back wall 76, a top wall 78, a bottom wall 80, a right wall 82, a left wall 84, and a U-shaped second channel 86 continuously disposed between the right wall 82 and the left wall 84. There is at least one pair of second holes 88 disposed on the back wall 76. One of each of the at least one pair of second holes 88 is disposed on one of the back wall 76 proximal the right wall 82 and the one of the at least one pair of second holes 88 is disposed on the back wall 76 proximal the left wall 84. Each of the at least one pair of first holes 70 and each of the at least one pair of second holes 88 is disposed in direct alignment with each other and each of the at least one pair of first holes 70 and the at least one pair of second holes 88 securingly receives a fastening device 90 therethrough. The securing engagement of the fastening device 90 through each of the at least one pair of first holes 70 and the at least one pair of second holes 88 of both of the at least one first bracket 54 and second bracket 72 secures the at least one first bracket 54 and second bracket 72 together directly across from each other on a body of a working tool.

Each of the first channel 68 and the second channel 86 have a width greater than a width of the tool body to allow the at least one first bracket 54 and the second bracket 72 to securingly engage the tool body.

A second stake puller member 92 is centrally disposed the front wall 56 of the second bracket 72. The second stake puller member 92 has an upper section 94 disposed proximal the top wall 78 and a lower section 96 disposed proximal the bottom wall 80. Each of the upper section 94 and the lower section 96 is parallel to the left wall 84 and the right wall 82. Each upper section 94 and lower section 96 has a convex external side 98 and an internal side 100. There is plurality of ridges 102 disposed on the internal side 100 of each of the upper section 94 and the lower section 96.

What is claimed is:

1. A removable universal stake puller comprising:

a first plate having a front side, a back side, a top side, a bottom side, a right side, a left side, and a V-shaped center portion of the back side;

at least one pair of apertures disposed through the front and back sides, one of each of the at least one pair of apertures disposed proximal one of the right side and the left side;

a second plate identical to the first plate, the second plate disposed in a mirror image position relative the first plate;

a stake puller member disposed on left side of the second plate, the stake puller member having an upper portion disposed proximal the top side and a lower portion disposed proximal the bottom side, wherein each of the upper portion and the lower portion is perpendicular to the left side, wherein each upper portion and the lower portion has a convex external wall and an internal wall;

a plurality of teeth disposed on the internal wall of each of the upper portion and the lower portion;

wherein each of the at least one pair of apertures of each of the first and second plates is disposed in direct alignment with each other;

wherein each of the at least one pair of apertures is configured to securingly receive a fastener therethrough;

wherein the securing engagement of the fastener through each of the at least one pair of the apertures of both of the first and second plates secures the first and second plate together directly across from each other on a body of a working tool; and wherein the stake puller member is configured and sized to securingly engage and remove a concrete foundation stake from a ground surface.

2. The removable universal stake puller of claim 1 wherein each of the upper portion and the lower portion have a width greater than a width of the left side.

3. The removable universal stake puller of claim 2 wherein the first plate and the second plate center section have a width greater than a width of the tool body; and wherein the v-shaped center portion securing engages the working tool.

4. The removable universal stake puller of claim 3 wherein the apertures are threaded.

5. The removable universal stake puller of claim 4 wherein the fastener is a set screw.

6. A removable universal stake puller comprising:

a first plate having a front side, a back side, a top side, a bottom side, a right side, a left side, and a V-shaped center portion of the back side;

at least one pair of apertures disposed through the front and back sides, one of each of the at least one pair of apertures disposed proximal one of the right side and the left side;

a second plate identical to the first plate, the second plate disposed in a mirror image position relative the first plate;

a first stake puller member disposed on left side of the second plate, the stake puller member having an upper portion disposed proximal the top side and a lower portion disposed proximal the bottom side, wherein each of the upper portion and the lower portion is perpendicular to the left side, wherein each upper portion and the lower portion has a convex external wall and an internal wall; and a plurality of teeth disposed on the internal wall of each of the upper portion and the lower portion;

wherein each of the at least one pair of apertures of each of the first and second plates is disposed in direct alignment with each other;

wherein each of the at least one pair of apertures is configured to securingly receive a fastener therethrough;

wherein the securing engagement of the fastener through each of the at least one pair of the apertures of both of the first and second plates secures the first and second plate together directly across from each other on a body of a working tool;

wherein the stake puller member is configured and sized to securingly engage and remove a concrete foundation stake from a ground surface;

wherein each of the upper portion and the lower portion have a width greater than a width of the left side;

wherein the first plate and the second plate center section have a width greater than a width of the tool body;

wherein the v-shaped center portion securing engages the working tool;

wherein the apertures are threaded; and wherein the fastener is a set screw.

7. A removable universal stake puller comprising:

at least one first bracket having a front end, a back end, a top end, a bottom end a right end, a left end, and a U-shaped first channel continuously disposed between the right end and the left end;

at least one pair of first holes continuously disposed through the front and back ends, one of each of the at least one pair of first holes disposed on one of the back end proximal the right end and one on the back end proximal the left end;

a second bracket having a front wall, a back wall, a top wall, a bottom wall, a right wall, a left wall, and a U-shaped second channel continuously disposed between the right wall and the left wall;

a second stake puller member centrally disposed on the front wall of the second bracket, the second stake puller member having an upper section disposed proximal the top wall and a lower section disposed proximal the bottom wall, wherein each of the upper section and the lower section is parallel to the left wall and the right wall, wherein each upper section and the lower section has a convex external side and an internal side;

at least one pair of second holes disposed on the back wall, one of each of the at least one pair of second holes disposed on one of the back wall proximal the right wall and one on the back wall proximal the left wall; and a plurality of ridges disposed on the internal side of each of the upper section and the lower section;

wherein each of the at least one pair of first holes and each of the at least one pair of second holes is disposed in direct alignment with each other;

wherein each of the at least one pair of first holes and second holes is configured to securingly receive a fastening device therethrough;

wherein the securing engagement of the fastening device through each of the at least one pair of the first holes and second holes of both of the at least one first bracket and the second brackets secures the at least one first bracket and the second bracket together directly across from each other on a body of a working tool;

wherein the second stake puller member is configured and sized to securingly engage and remove a concrete foundation stake from a ground surface;

wherein the first channel and the second channel have a width greater than a width of the tool body;

wherein the first channel and the second channel securingly engages the working tool body;

wherein each of the at least one pair of first holes and the at least one pair of second holes are threaded; and wherein the fastening device is a set screw.

* * * * *